US005207531A

United States Patent [19]

Ross

[11] Patent Number: 5,207,531

[45] Date of Patent: May 4, 1993

[54] ARTIFICIAL SURFING REEF

[76] Inventor: Gary Ross, 140 Oxnard Ave., Oxnard, Calif. 93035

[21] Appl. No.: 754,390

[22] Filed: Sep. 3, 1991

[51] Int. Cl.[5] ..... E02B 3/06

[52] U.S. Cl. ..... 405/79; 405/23; 405/25

[58] Field of Search ..... 405/15, 21, 23, 25, 405/30, 52, 79, 171, 195.1, 203, 205; 472/128

[56] References Cited

U.S. PATENT DOCUMENTS

| | | | |
|---|---|---|---|
| 1,610,341 | 12/1926 | Wells | 405/21 |
| 4,465,399 | 8/1984 | Kikuzawa et al. | 405/231 X |
| 4,790,685 | 12/1988 | Scott et al. | 405/211 X |
| 4,887,931 | 12/1989 | Frisby et al. | 405/171 |
| 4,954,014 | 9/1990 | Sauerbier et al. | 405/79 |

FOREIGN PATENT DOCUMENTS

| | | | |
|---|---|---|---|
| 3331563 | 3/1985 | Fed. Rep. of Germany | 405/15 |
| 1471649 | 3/1967 | France | 405/21 |
| 1108159 | 8/1984 | U.S.S.R. | 405/21 |

*Primary Examiner*—Dennis L. Taylor
*Assistant Examiner*—John Ricci
*Attorney, Agent, or Firm*—Thomas I. Rozsa; Dong Chen

[57] ABSTRACT

The present invention is an artificial surfing reef for modifying near shore ocean floor bottom to create surfing waves. The artificial surfing reef is a generally Y-shaped structure made of many large sized polyvinyl chloride pipes and having a leading leg and two main legs joined at a joint, where the leading leg extends from the joint toward the offshore direction. As a swell moves toward the shore, its bottom is resisted by the leading leg of the artificial surfing reef, and its top topples over the joint and is tapered by the two main legs of the artificial surfing reef to thereby form perfect surfing waves.

27 Claims, 4 Drawing Sheets

FIG. 1
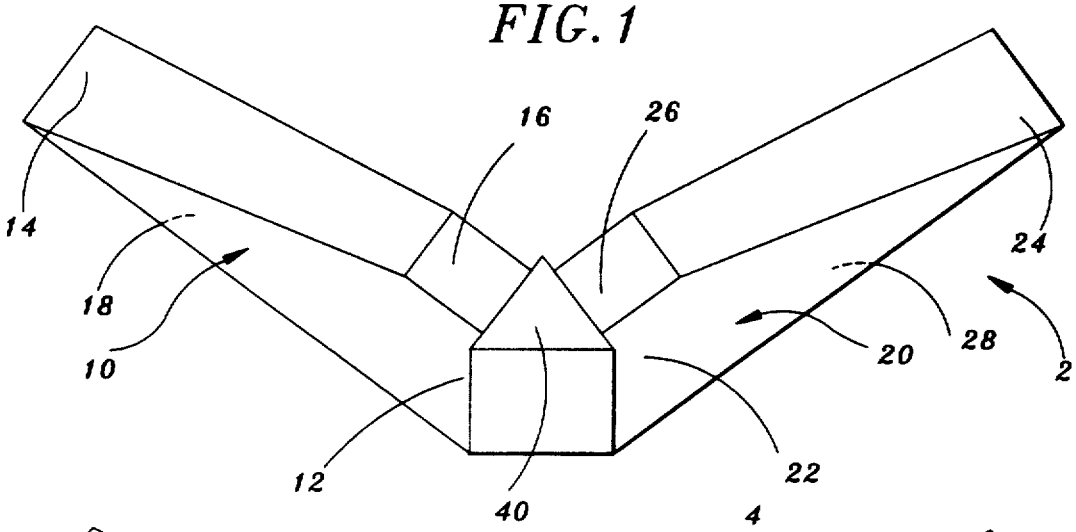
FIG. 2
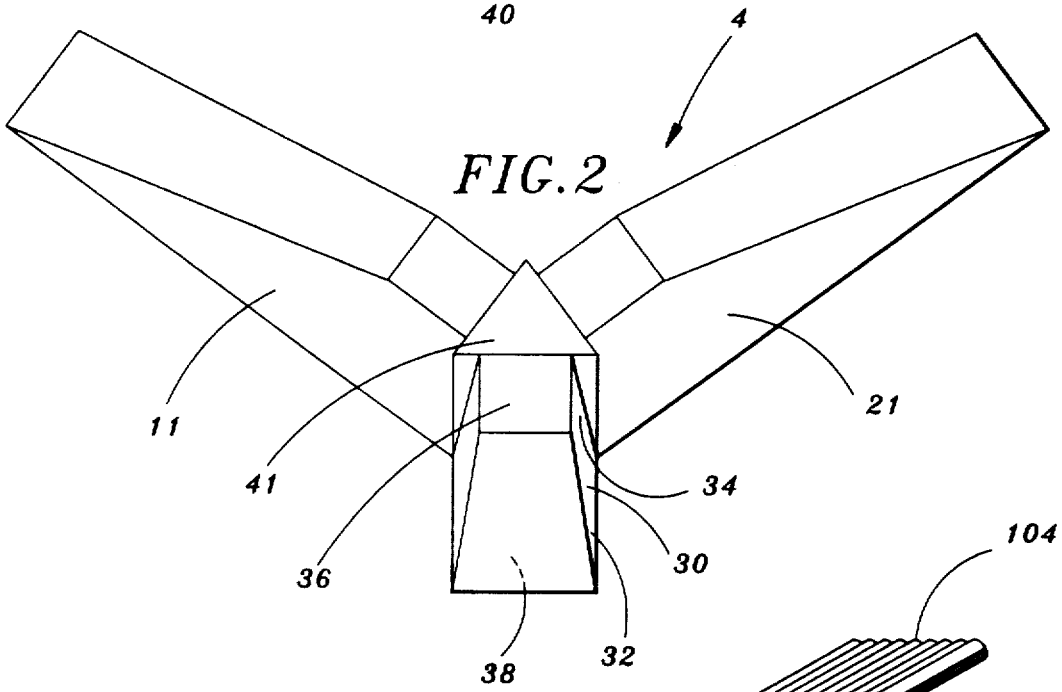
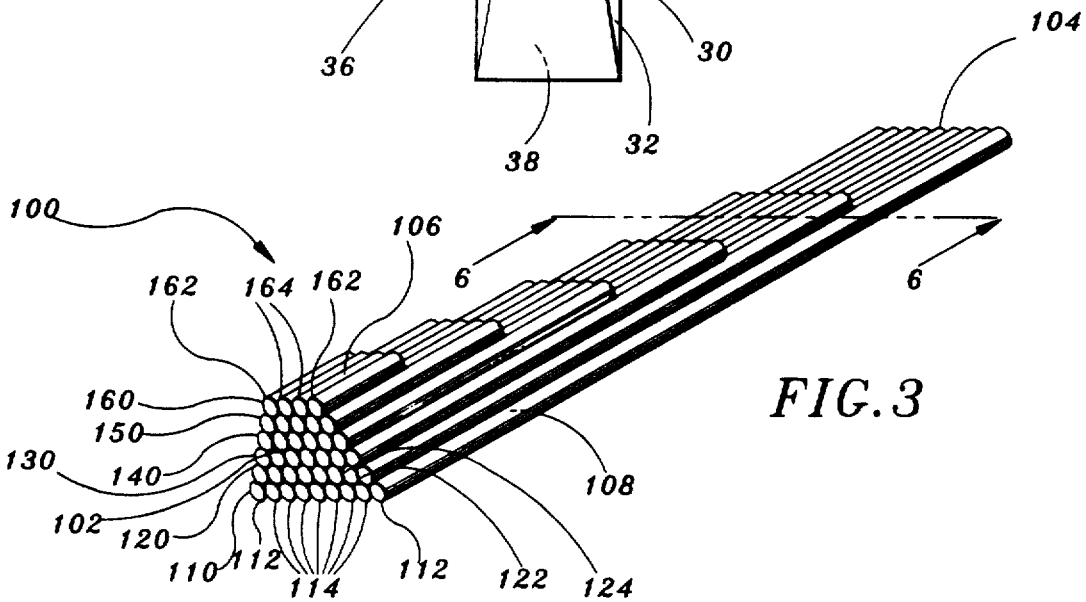
FIG. 3

FIG. 6
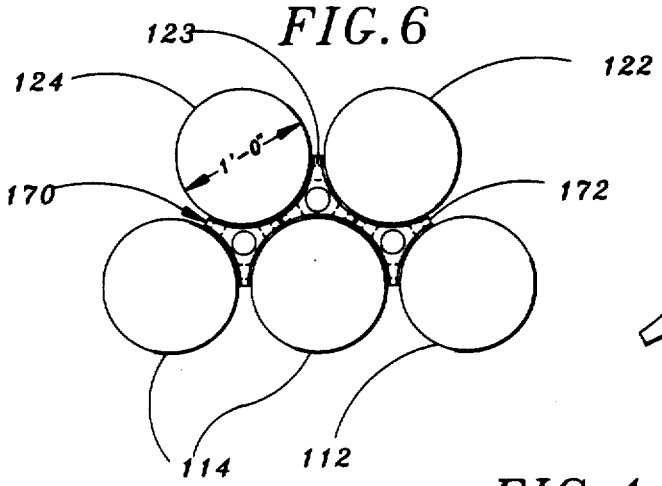
FIG. 7
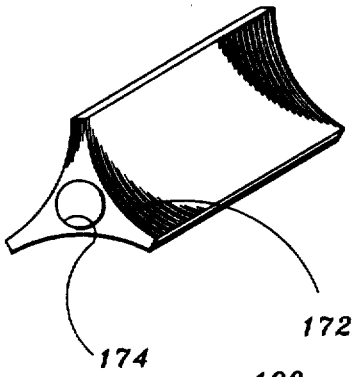
FIG. 4
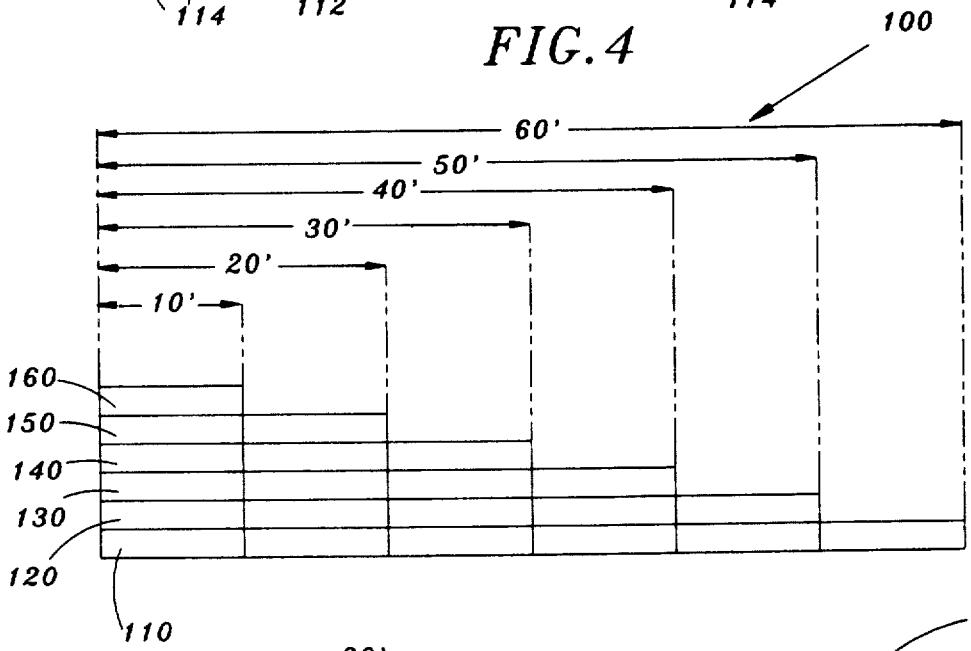
FIG. 5
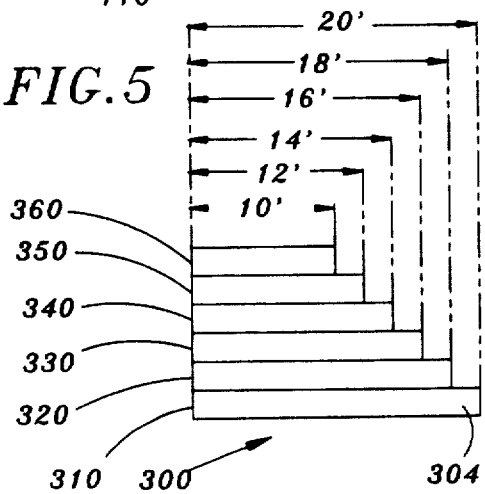
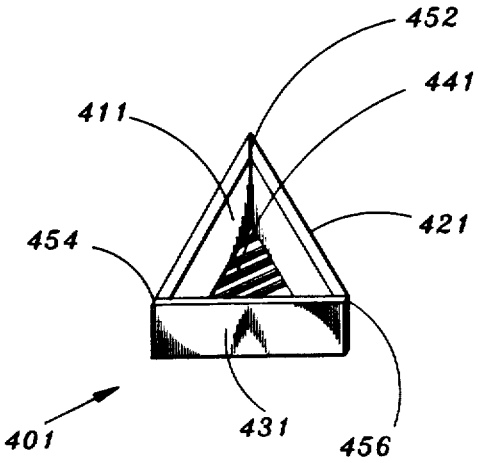
FIG. 11

FIG. 8
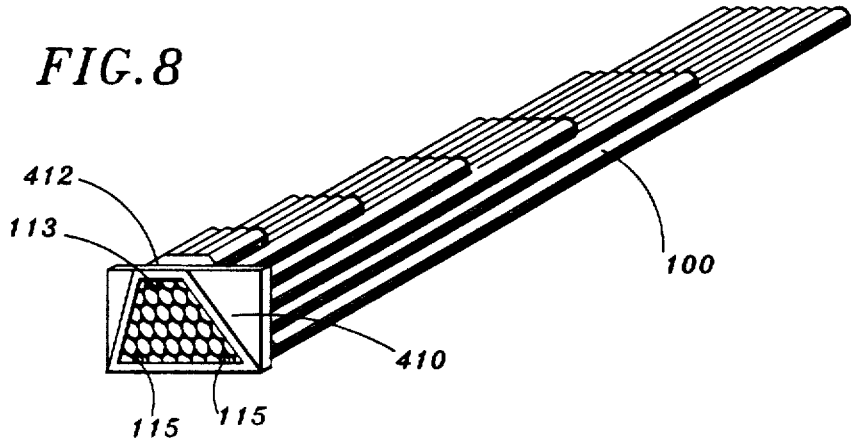
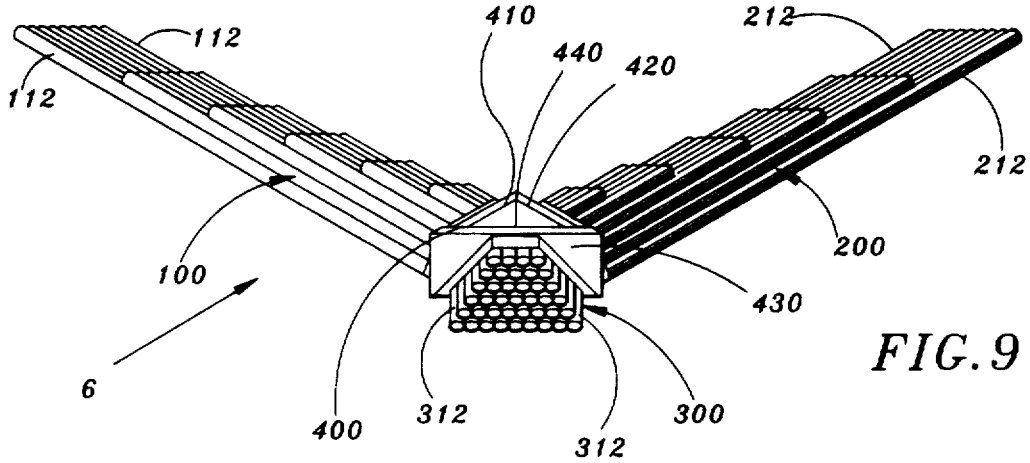
FIG. 9
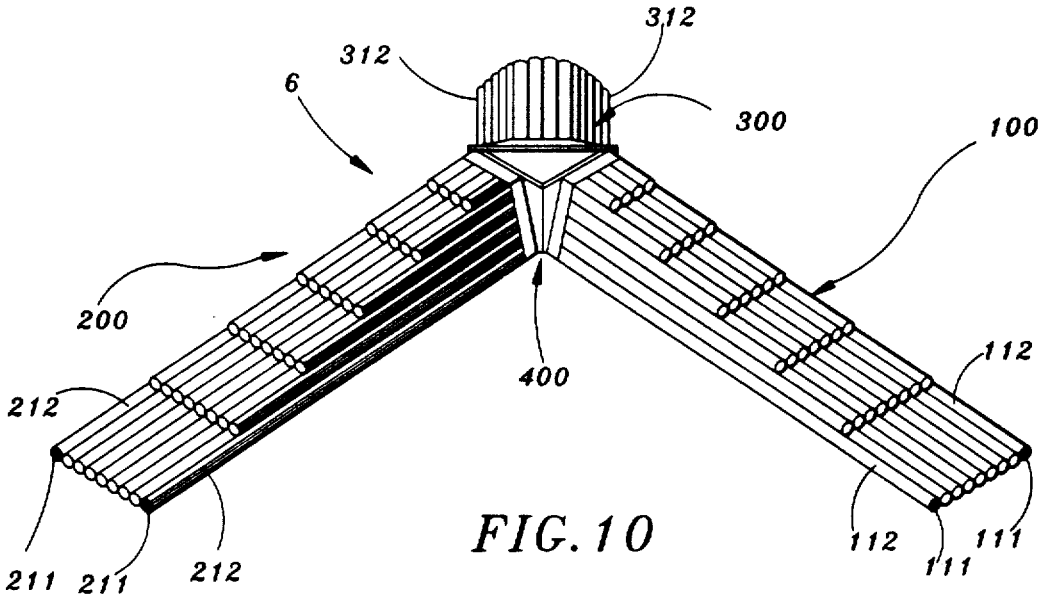
FIG. 10

(Section on line 13 - 13)

ARTIFICIAL SURFING REEF

BACKGROUND OF THE INVENTION

1. Field of the Invention

The present invention relates to the field of design and construction of an artificial offshore reef. More particularly the present invention relates to the field of design and construction of small scale artificial offshore reef to modify the ocean floor bottom for the sport of surfing.

2. Description of the Prior Art

Surfing is a popular sport. When a surfer rides a surfing wave, the force of the surfing wave makes him travel at a high sped on the peak of the surfing wave, which creates a great thrill.

It is pleasurable for a surfer to ride a perfect surfing wave. A surfing wave is formed when the bottom of a swell is slowed down by a certain configuration of the offshore ocean floor bottom, and the top of the swell topples over. The perfect surfing wave travels diagonally toward the shore and the top of the swell continuously topples over. Such a diagonally traveling surfing wave maintains not only a longitudinal hydrodynamic force aiming in a direction toward the shore, but also a transverse hydrodynamic force aiming in a direction along the shore. As the surfer rides the perfect surfing wave, he travels at a much greater speed since he is taking advantage of both hydrodynamic forces, and the combination of the two hydrodynamic forces is certainly greater than each individual one of the forces. In addition, within a limited distance perpendicular to the shore, the diagonally traveling surfing wave travels a longer passage, which gives the surfer a much longer ride.

However, the average waves found on most sandy beaches are imperfect for surfing. An imperfect surfing wave simply moves in a direction perpendicular to the shore and loops over along a single line parallel to the shore. It does not provide a surfer a continuously toppling wave, nor the opportunity to take the desirable riding angle. The reason that most sandy beaches do not provide the perfect surfing waves is that their near shore ocean floor bottoms do not have the desirable configuration that properly slows down the bottom of the swell and makes the swell move in a diagonal direction.

Unfortunately, as surfing is becoming a more and more popular sport, only a limited number of beaches have the desirable near shore ocean floor bottoms that provide perfect surfing waves, and these beaches are becoming more and more unbearably crowded. One way to solve this problem is to build offshore constructions to change the offshore ocean conditions of the average sandy beaches, so they can provide perfect surfing waves.

So far there has been no offshore construction ever designed and constructed for the purpose of surfing, although historically certain constructions have been built to modify the offshore ocean condition for other purposes. There are two major types of offshore constructions built to change the offshore ocean conditions: offshore jetties and underwater reefs, aiming at two different objectives. The offshore jetties have been built to modify the offshore ocean swell directions and patterns, whereas the artificial reefs have been built to modify the offshore ocean floor bottom.

The offshore jetties have been built for various purposes such as fishing, tidal power generation and beach erosion prevention. The option of constructing an offshore jetty for the sole purpose of surfing is practically unavailable, because such a large scale offshore jetty is simply not effective in modifying the directions and patterns of the near shore swell for the purpose of surfing. It is also not justifiable to construct an offshore jetty for the sole purpose of surfing because of its high cost of construction and its adverse effects on large scale beach environment.

Another option is to construct an artificial reef. Historically most artificial reefs have been built for the purpose of fishing. In recent years some artificial reefs have been built for the purpose of dissipating the energy of the swell to protect the near shore structures or prevent bach erosions. These traditional artificial reefs are usually designed with large scale linear configurations, and are constructed with very heavy and bulky materials such as large rocks or cast concrete forms. The construction of such artificial reefs involves very heavy equipment such as barges with the cranes, and is very costly. In addition, these traditional artificial reefs are permanently disposed.

It is obvious that these old fashioned methods of the artificial reef construction are not longer suitable for the construction of artificial reefs for purpose of surfing. For example, the artificial reefs designed for fishing enhancement are usually built far off the shore. If an artificial reef is to be built for the purpose of surfing, it has to be located very close to the shore such that the surfing waves generated by the reef are accessible for surfers. Using heavy equipment for transporting heavy and bulky materials at locations very close to the shore is both unsafe to the construction workers and harmful to the immediate environment of the nearby beach.

It will be desirable to design and construct a small scale artificial reef that is built with light and environmentally inert material and can be easily transported and installed at locations very close to the shore. The purpose of the artificial reef is to modify the offshore ocean floor bottom such that perfect surfing waves may be generated for the purpose of surfing, where the installation of the artificial reef contributes no harm to the immediate beach environment.

SUMMARY OF THE INVENTION

The present invention is an artificial reef designed and constructed for the purpose of surfing.

It is known that an appropriate configuration of the offshore ocean floor bottom can create a perfect surfing wave where its top continuously topples over and travels diagonally toward the shore, which makes a surfer travel at a much greater speed and gives him a much longer ride. It is also known that placing an artificial reef on the offshore ocean floor bottom will have the effect of modifying the configuration of the offshore ocean floor bottom. However, the currently built artificial reefs are primarily not designed for surfing and the current methods of constructing the artificial reefs are not suitable for building the artificial surfing reefs.

It has been discovered, according to the present invention, that when an artificial reef is placed on the offshore ocean floor bottom to modify the offshore ocean floor bottom for the purpose of surfing, it needs to be located very close to the shore so that the surfing waves created by the artificial reef are easily accessible by the majority of surfers from the beach. This close-to-shore installation requires that while the physical dimensions of the artificial surfing reef needs to be adequately large for generating surfing waves, the artificial surfing reef should be small enough such that even at lowest tide it will not be visible from the beach. The close-to-shore installation also requires that the artificial surfing reef is built from light material so no heavy equipment is involved. In addition, the material used to build the artificial reef must be environmentally safe.

It has also been discovered, according to the present invention, that a generally V-shaped isosceles triangular reef is very effective in creating perfect surfing waves. The two main legs are disposed backwardly toward the shore, and the joint of the two main legs is placed furthest offshore. When a swell moves toward the shore, its bottom will contact the joint of the reef first which in turn creates resistance on the bottom of the swell, and the top of the swell will topple over. As the top of the swell topples over to generate a surfing wave, the two main legs of the reef act to taper the surfing wave in two diagonal directions to thereby create perfect surfing waves.

It has further been discovered, according to the present invention, that a leading leg can be added to the generally V-shaped triangular reef to extend forwardly from the joint of the reef toward the deep ocean direction to thereby form a generally Y-shaped artificial surfing reef. The generally Y-shaped artificial surfing reef is more effective than the generally V-shaped reef, because before the bottom of the swell hits the joint of the two main legs of the reef the leading leg acts to increase the resistance on it to slow it down before the swell hits the legs of the Y-shaped structure.

It has additionally been discovered, according to the present invention, that to make the generally Y-shaped artificial surfing reef sturdy and stable, each one of its legs should be a three dimensional structure having an elongated longitudinal dimension and generally triangular or trapezoid shaped transverse cross sections. This means that each leg of the generally Y-shaped artificial surfing reef should have an elongated body with a narrower top and a wider base. When the generally Y-shaped artificial surfing reef is placed on the offshore ocean floor bottom, the wider bases of its three legs contact the ocean floor bottom, which provides stability to the whole reef structure. In addition, the three dimensional structure of each leg of the generally Y-shaped artificial surfing reef should be higher at its proximal end, which is the end adjacent to the joint of the legs, and lower at its opposite distal end. Therefore the generally Y-shaped artificial surfing reef has a higher center and a lower circumference, which increases the stability of the whole reef structure.

It has also been discovered, according to the present invention, that each leg of the generally Y-shaped artificial surfing reef can be constructed by bonding many elongated large diameter Polyvinyl Chloride (PVC) pipes together. The PVC pipes are relatively light in weight, so there is no requirement for heavy equipment in the complete process of construction, transportation and installation of the artificial surfing reef. In addition, the PVC pipes are strong and hard enough to withstand the impacting forces of the ocean swell. The PVC pipes are also durable for long term use, and they will not interact with the seawater. In addition, the PVC pipes are harmless to the ocean wildlife and beach environment.

It has further been discovered, according to the present invention, that the three dimensional structure of each leg of the generally Y-shaped artificial surfing reef may be constructed by stacking many layers of PVC pipes together, where each individual layer is formed by bonding a number of elongated PVC pipes side by side, and the stacked layers may have different lengths and widths. To build the elongated three dimensional structure having a narrower top and wider bottom, the upper layers need to be assembled with fewer pipes, and the lower layers need to be assembled with more pipes. To build the elongated three dimensional structure having a higher proximal end and a lower distal end, the upper layers need to be assembled with shorter pipes, the lower layers need to be assembled with longer pipes, and the proximal ends of all layers need to be aligned.

It has additionally been discovered, according to the present invention, that the PVC pipes used in building the artificial surfing reef can be sealed at their proximal and distal ends and interconnected by small passages, such that each three-dimensional structure of the generally Y-shaped artificial surfing reef has an integrated inner hollow chamber. Having proper valve devices installed, the whole reef structure can be sunk into the ocean by filling its inner hollow chambers with seawater, or re-floated by plumbing air into its inner hollow chambers. Therefore after the whole reef structure is built on the ground, it can be sealed so that it can float on the water and be towed to the surfing location for installation. In addition, an installed reef structure can be removed by pumping air into its inner hollow chambers so that it can re-float on the water and be towed away to a different location or be inspected or serviced.

It has also been discovered, according to the present invention, that the two main legs of the generally Y-shaped artificial surfing reef may be hingeably attached to each other and to the leading leg at their proximal ends, such that when being towed on the water, the two main legs can swing-i to be parallel to each other and aligned with the leading leg to reduce the hydrodynamic resistance; and when being installed, the two main legs can swing-out by a certain angle to form the two diagonal legs of the Y-shape.

It has further been discovered, according to the present invention, that some selected ones of the assembled PVC pipes may be further filled with concrete to ballast the whole reef structure, so that the generally Y-shaped artificial surfing reef is heavy enough to not move with large ocean swell when it is submerged in the water, but not too heavy to prevent it form being re-floated.

It has additionally been discovered, according to the present invention, that after the two hingeably attached main legs are swung out with an angle to form the generally Y-shaped artificial surfing reef, one or more struts may be added to the generally Y-shaped reef structure, which struts are parallel to the shore and attached to the two main legs, to further strengthen the overall reef structure.

It has further been discovered, according to the present invention, that the artificial surfing reef not only constitutes no harm to the near shore beach structures, but even provides benefit to the near shore beach structures, because the artificial surfing reef structure properly creates resistance on the ocean floor bottom that makes the waves break offshore and therefore dissipates the energy of the ocean swell.

It is therefore an object of the present invention to provide an artificial surfing reef on the offshore ocean floor bottom, at a location very close to the shore, to modify the offshore ocean floor bottom for the purpose of creating perfect surfing waves which are easily accessible by the majority of surfers from the beach.

It is also an object of the present invention to provide a generally Y-shaped artificial surfing reef having two main legs disposed outwardly and backwardly toward the shore, and a leading leg extended forwardly from the joint of the two main legs toward the deep ocean direction, such that when a swell moves toward the shore, the leading leg of the reef contacts the bottom of the swell first to slow it down, so that the top of the swell will topple over the joint of the reef to generate a surfing wave, and the two main legs taper the surfing wave in two diagonal directions, so that diagonally fast traveling perfect surfing waves are created.

It is a further object of the present invention to provide a generally Y-shaped artificial surfing reef, where each one of its legs is a three dimensional structure having an elongated longitudinal dimension and generally triangular or trapezoid shaped transverse cross sections, and being higher at its proximal end adjacent to the joint of the reef and lower at its opposite distal end, so that the overall stability of the generally Y-shaped artificial surfing reef is substantially increased when it is placed on the offshore ocean floor bottom.

It is an additional object of the present invention to provide a generally Y-shaped artificial surfing reef, where each leg of the generally Y-shaped artificial surfing reef is constructed with elongated large diameter Polyvinyl Chloride (PVC) pipes, which are light in weight for construction, transportation and installation, yet strong and durable to withstand the impacting forces of the ocean swell for a long period, and further inert to the offshore and coastal environment.

It is also an object of the present invention to provide a generally Y-shaped artificial surfing reef, where the three dimensional structure of each leg of the generally Y-shaped artificial surfing reef is constructed by bonding many elongated PVC pipes together in stacked layers, where the upper layers are assembled with less pipes, and the lower layers are assembled with more pipes, to make the elongated three dimensional structure narrower at its top and wider at its bottom, and where the upper layers are assembled with shorter pipes, the lower layers are assembled with longer pipes, and the proximal ends of all layers need to be aligned, to make the elongated three dimensional structure higher at its proximal end and lower at its distal end.

It is a further object of the present invention to provide a generally Y-shaped artificial surfing reef, where the PVC pipes of each of the three dimensional structures of the artificial surfing reef are sealed at their ends and interconnected to each other by small passages, such that each three-dimensional structure of the generally Y-shaped artificial surfing reef has an integrated inner hollow chamber, so that with proper valve devices installed, the whole reef structure can float and be towed on the water to a surfing location after it is assembled, and be sunk into the ocean by filling its inner hollow chambers with seawater; and if needed, be refloated by plumbing air into its inner hollow chambers.

It is an additional object of the present invention to provide a generally Y-shaped artificial surfing reef, where two main legs of the generally Y-shaped artificial surfing reef are hingeably attached to each other and to the leading leg at their proximal ends, such that when being towed on the water, the two main legs can swing-in to be parallel to each other and aligned with the leading leg to reduce the hydrodynamic resistance; and when being installed, the two main legs can swing-out by a certain angle to form the two diagonal legs of the Y-shape.

It is also an object of the present invention to provide a generally Y-shaped artificial surfing reef, where certain selected ones of the assembled PVC pipes are pumped with concrete to ballast the whole reef structure, so that the generally Y-shaped artificial surfing reef is heavy enough to not move with large ocean swell when it is submerged in the water, but not too heavy to prevent it from floating.

It is a further object of the present invention to provide a generally Y-shaped artificial surfing reef, where one or more struts are added to the generally Y-shaped reef structure, parallel to the shore and attached to the two main legs, to further strengthen the overall reef structure.

It is an additional object of the present invention to provide a generally Y-shaped artificial surfing reef which constitutes no harm to the near shore beach structures, and moreover, it even benefits the coastal environment since it dissipates the energy of the ocean swell.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 1 is an illustrative sketch of the three dimensional structure of the generally V-shaped construction of the present invention artificial surfing reef.

FIG. 2 is an illustrative sketch of the three dimensional structure of the generally Y-shaped construction of the preferred embodiment of the present invention artificial surfing reef.

FIG. 3 is a perspective view of the three dimensional structure of one of the two elongated main legs of the generally Y-shaped artificial surfing reef of the present invention, which is assembled by a large quantity of large sized polyvinyl chloride pipes arranged in stacked layers.

FIG. 4 is a side view of one of the two elongated main legs of the generally Y-shaped artificial surfing reef of the present invention.

FIG. 5 is a side view of the leading leg of the generally Y-shaped artificial surfing reef of the present invention.

FIG. 6 is an enlarged partial cross-sectional view taken along line 6—6 of FIG. 3, showing that the polyvinyl chloride pipes are bonded together by the modified triangular shaped extrusion members.

FIG. 7 is a perspective view of one of the modified triangular shaped extrusion members shown in FIG. 6.

FIG. 8 is a perspective view of the three dimensional structure of one of the two elongated main legs of the generally Y-shaped artificial surfing reef of the present invention, showing that an end board is attached.

FIG. 9 is a perspective view of the three dimensional structure of the generally Y-shaped construction of the present invention artificial surfing reef, as viewed when looking toward the shore direction.

FIG. 10 is a perspective view of the three dimensional structure of the generally Y-shaped construction of the present invention artificial surfing reef, as viewed when looking toward the offshore direction.

FIG. 11 is a perspective view of the three dimensional structure of the generally triangular shaped hub of the present invention artificial surfing reef.

DESCRIPTION OF THE PREFERRED EMBODIMENT

Figure 14:
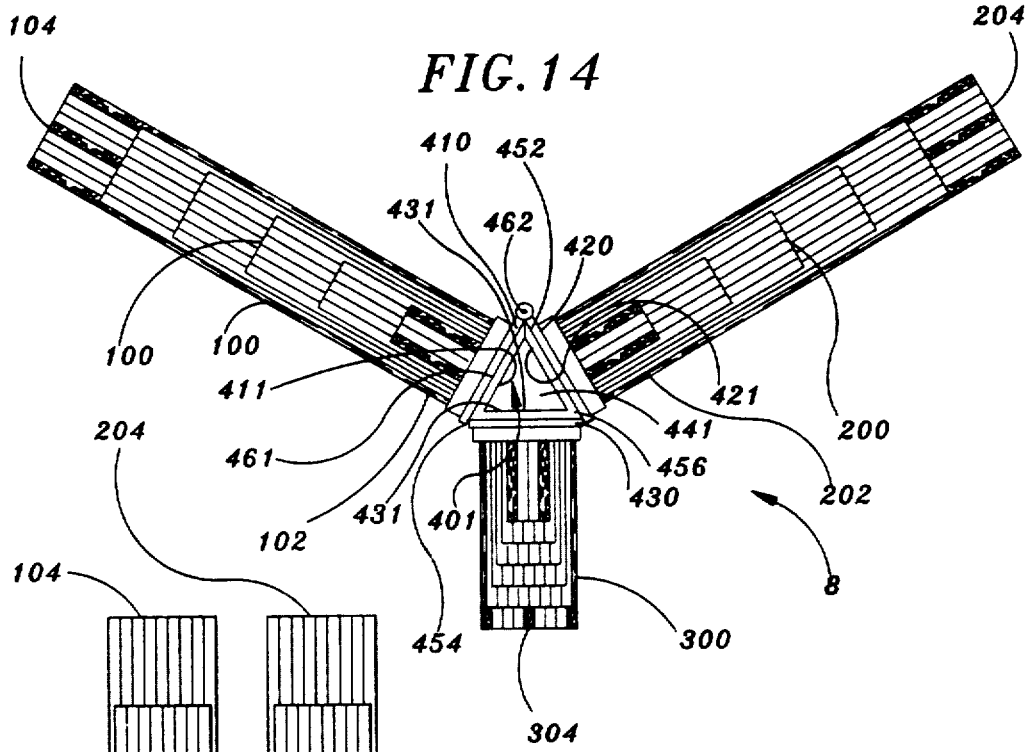
FIG. 14 is a top view of the present invention artificial surfing reef in the installed position, where its tow main legs are separated by an angle.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIG. 1, there is shown at 2 an illustrative sketch of the three dimensional structure of the generally V-shaped construction of the present invention artificial surfing reef. This generally V-shaped configuration is one of the novel features of the present invention. The generally V-shaped structure 2 has a first elongated main leg 10 and a second elongated main leg 20. The two elongated main legs are joined at a joint 40. When placed on the offshore ocean floor bottom, the hub 40 is located furthest offshore. As a swell moves toward the shore, the joint or hub 40 will contact the bottom of the swell first and create resistance on the bottom of the swell. The top of swell will then topple over the joint 40. AT this point the resistance caused by the two elongated main legs 10 and 20 will act to taper the wave in both directions, right and left of the joint 40, to thereby create surfing waves which are travelling diagonally along the directions of the two elongated main legs 10 and 20.

To make the three dimensional structure stable and strong, and to help improve the quality of the surfing waves created, the configurations of the two elongated main legs 10 and 20 are carefully designed. In most of the practical situations, it is desirable to make to the two elongated main legs 10 and 20 identical. The preferable three dimensional design of the first and second elongated main legs 10 and 20 will be introduced below. Since the two main elongated main legs 10 and 20 are identical, the attention is now directed to the first elongated main leg 10. The first elongated main leg 10 has a longitudinally elongated body with a proximal end 12 and a distal end 14, where the proximal end 12 is connected to the joint 40. The first elongated main leg 10 is highest at its proximal end 12 and lowest at its distal end 14, and its height is generally gradually reduced from its proximal end 12 to its distal end 14. The body of the first elongated main leg 10 also has a top 16 and a bottom 18, where the bottom 18 will contact the offshore ocean floor bottom. The first elongated main leg 10 is narrowest at its top 16 and widest at its bottom 18, and its width is generally gradually increased from its top 16 to its bottom 18. Therefore, the transverse cross-sections of the first elongated main leg 10 may be generally trapezoid shaped. Alternatively, the transverse cross-sections of the first elongated main leg 10 may be generally triangular shaped. The three dimensional design of the second elongated main leg 20 is similar to the three dimensional design of the first elongated main leg 10. As the first and second elongated main legs 10 and 20 are joined at the joint 40, the highest portion of the generally V-shaped artificial surfing reef 2 will be the joint 40, which makes the overall shape of the artificial surfing reef 2 close to a natural reef. One of the main purposes of the above described three dimensional designs of the generally V-shaped artificial surfing reef 2 is to provide it a superior stability to remain on the offshore ocean floor bottom, and a superior strength to withstand the hydrodynamic forces put upon it by the ocean swell.

It is understood that in this text, the phrase "proximal end" of an respective species always refers the end located adjacent to the central joint of the structure, and the phrase "distal end" of the respective species always refers to the opposite end, which is located remote from the central joint of the structure.

The generally V-shaped construction presents the basic structure of the present invention artificial surfing reef. More preferably, a leading leg is attached to the generally V-shaped artificial surfing reef, such that it becomes a generally Y-shaped artificial surfing reef. Referring to FIG. 2, there is shown at 4 an illustrative sketch of the three dimensional structure of the generally Y-shaped construction of the preferred embodiment of the present invention artificial surfing reef.

This generally Y-shaped configuration is a further novel feature of the present invention. The generally Y-shaped structure 4 also has a first elongated main leg 11 and a second elongated main leg 21 joined at a joint 41, which are similar to the generally V-shaped structure 2. In addition, a leading leg 30 is now added and extending from the joint 40 toward the offshore direction. Thus when the generally Y-shaped artificial surfing reef 4 is placed on the offshore ocean floor bottom its leading leg 30 is furthest offshore. As a swell moves toward the shore, the leading leg 30 will contact the bottom of the swell first and create resistance on the bottom of the swell, so that the bottom of the swell is slowed down by the leading leg 30 before the swell reaches the joint 41. The leading leg 30 also acts as a guide which regulates and leads the swell, so the swell moves in a straight line toward the joint 41 along the leading leg 30. When the swell finally reaches the joint 41, the top of swell topples over the joint 41 and is tapered by the two elongated main legs 11 and 21. Since the bottom of the swell is antecedently slowed down and guided by the leading leg 30, the quality of the surfing waves created by the generally Y-shaped artificial surfing reef 4 is further improved.

The configurations of the two elongated main legs 11 and 21 of the generally Y-shaped structure 4 are similar to the configurations of the two elongated main legs 10 and 20 of the generally V-shaped structure 2, which have been introduced in detail. For the generally Y-shaped structure 4, it is preferable to make the three dimensional configuration of its leading leg 30 similar to the three dimensional configurations of its first and second elongated main legs 111 and 21. The leading leg 11 will have a longitudinal body with a proximal end 34 and a distal end 32, where the proximal end 34 is connected to the joint 41 of the generally Y-shaped structure 4, and the distal end 32 is disposed furthest offshore. The leading leg 30 is highest at its proximal end 34 and lowest at its distal end 32, and its height is generally gradually reduced from its proximal end 34 to its distal end 32. The body of the leading leg 30 also has a top 36 and a bottom 38, where the bottom 38 will contact the offshore ocean floor bottom. The leading leg 30 is narrowest at its top 36 and widest at its bottom 38, and its width is generally gradually increased from its top 36 to its bottom 38. Therefore, the transverse cross-sections of the leading leg 30 may be generally trapezoid shaped. Alternatively, the transverse cross-sections of the leading leg 30 may be generally triangular shaped. The overall length of the leading leg 30 is substantially shorter than the overall length of each of the two elongated main legs 11 and 21. Preferably, the overall length of the leading leg 30 is approximately one third of the overall length of each of the two elongated main legs 11 and 21. Again, one of the main purposes of the above described three dimensional design of the generally Y-shaped artificial surfing reef 4 is to provide it a superior stability to remain on the offshore ocean floor bottom, and a superior strength to withstand the hydrodynamic forces put upon it by the ocean swell. Another main purpose is to build the artificial surfing reef in a better configuration so that it can create superior quality surfing waves.

What has been introduce so far is focused on the three dimensional configuration of the artificial surfing reef of the present invention. Now the attention is directed to the fabrication of the actual artificial surfing reef. The fabrication of the generally Y-shaped construction will be presented below. As discussed, the three major components of the generally Y-shaped construction are the two elongated main legs and the leading leg. The construction of the three legs will be discussed below in detail.

One of the significant novel features of the present invention is to construct each leg of the artificial surfing reef with a pipe structure assembled from a large quantity of large sized Polyvinyl Chloride (PVC) pipes. The PVC pipes are environmentally inert, which means they will not interact with the offshore and coastal environment, thus present no harm to the ocean and shore wildlife. The PVC pipes are also light in weight for construction, transportation and installation, but strong and durable to sustain the impacting forces of the ocean swell. By way of example, the large sized PVC pipes used in one preferred embodiment of the present invention are the well known Schedule 80 PVC pipes. A standard Schedule 80 PVC pipe may by one foot (1') in diameter and twenty feed (20') in length. Longer or shorter lengths pipes can be made of a suitable number of twenty foot (20') segments coupled together at their ends and cut to the specific lengths. Referring to FIG. 3, there is shown at 100 a perspective view of the large scale pipe structure of the first elongated main leg of the generally Y-shaped artificial surfing reef of the present invention. It is understood that although specific information is given in the description below, any other suitable numbers may be incorporated in the various embodiments of the present invention artificial surfing reef.

The pipe structure 100 comprises thirty-nine (39) PVC pipes arranged in six (6) stacked layers including a bottom layer 110, a top layer 160 and four (4) intermediate layers 120, 130, 140 and 150. Each PVC pipe has an elongated body with a proximal end, a distal end and a hollow inner chamber. Each respective layer has a respective number of identical PVC pipes placed side by side in parallel. The respective number of PVC pipes placed in a respective layer have the same length. Their proximal ends are aligned together, which constituted the proximal end of the respective layer. Their distal ends are also aligned together, which constitute the distal ends of the respective layer. The proximal ends of all six (6) layers are aligned together, which constitutes the proximal end 102 of the three dimensional pipe structure 100. However, the distal ends of the six (6) layers are not aligned, because the PVC pipes used in different layers are different in length. The PVC pipes used in the bottom layer 110 are the longest PVC pipes, therefore the distal end of the bottom layer 110 constitutes the distal end 104 of the three dimensional pipe structure 100. In addition, the top layer 160 serves as the top 106 of the three dimensional pipe structure 100, and the bottom layer 110 serves as the bottom 108 of the three dimensional pipe structure 100.

Referring to FIGS. 3 and 4, the bottom layer 110 comprises nine (9) sixty foot (60') long PVC pipes including two (2) outer pipes 112 and seven (7) inner pipes 114. The first intermediate layer 120 comprises eight (8) fifty foot (50') PVC pipes including two (2) outer pipes 122 and six (6) inner pipes, and they are nested in the depressions of the bottom layer 101. Similarly and sequentially, the next intermediate layer 130 comprises seven (7) forty foot (40') PVC pipes nested in the depressions of the previous lower layer 120, the third intermediate layer 140 comprises six (6) thirty foot (30') PVC pipes nested in the depressions of the previous lower layer 130, and the last intermediate layer 150 comprises five (5) twenty foot (20') PVC pipes nested in the depressions of the previous lower layer 140. Finally, the top layer 160 comprises four (4) ten foot (10') PVC pipes nested in the depressions of the last intermediate layer 150. The proximal ends of all six (6) stacked layers are aligned serving as the proximal end 102 of the three dimensional pipe structure 100, as previously mentioned.

The overall configuration of the so constructed three dimensional pipe structure 100 will be similar to the overall configuration of the earlier discussed elongated main leg 11 of the generally Y-shaped structure 4. To summarize, the three dimensional structure 100 has a longitudinal body with a proximal end 102 and a distal end 104, where it is highest at its proximal end 102 and lowest at its distal end 104, and its height is generally gradually reduced from its proximal end 102 to its distal end 104. The body of the three dimensional pipe structure 100 also has a top 106 and a bottom 108, where it is narrowest at its top 106 and widest at its bottom 108, and its width is generally gradually increased from its top 106 to its bottom 108. Therefore, the transverse cross-sections of the three dimensional pipe structure 100 are generally trapezoid shaped.

The large scale pipe structures of the second elongated main leg and the leading leg of the generally Y-shaped artificial surfing reef of the present invention can be similarly assembled. The specific dimensions of the three dimensional pipe structure of the second elongated main leg are exactly the same as the dimensions of the three dimensional pipe structure 100 of the first elongated main leg, as described above. However, although the three dimensional pipe structure of the lead leg has the same number of PVC popes distributed in the same number of stacked layers in the same manner as the three dimensional pipe structures of the first and second elongated main leg do, the respective lengths of the stacked layers of the three dimensional pipe structure of the lead leg are different than the corresponding ones of the first and second elongated main legs.

Referring to FIG. 5, the three dimensional pipe structure 300 of the leading leg of the generally Y-shaped artificial surfing reef also has six (6) layers including a bottom layer 310, a top layer 360 and four (4) intermediate layers 320, 330, 340 and 350. However, the longest bottom layer 310 is only twenty foot (20') long, which is one third of the length of the bottom layer 110 of the three dimensional pipe structure 100 of the first elongated main leg. The length of the next layer up, which is the first intermediate layer 320, is 18 feet (18'), and the length of each subsequent upper layer is reduced by a two foot (2') decrement. Accordingly the length of the top layer 360 is only ten feet (10'). When placed on the offshore ocean floor bottom, the distal end 304 of this three dimensional pipe structure 300 of the leading leg is furthest offshore and contacts the bottom of the swell first. Since the height of the leading leg is generally gradually increased from its distal end 304, as shown in FIG. 5, the resistance created by the leading leg and exerted on the bottom of the swell is increased as the swell moves further toward the joint of the generally Y-shaped artificial surfing reef, and therefore helps to create high quality surfing waves.

In assembling the large scale pipe structures of the three legs of generally Y-shaped artificial surfing reef, the large number of PVC pipes may be bonded together by any suitable mechanical methods using suitable hardware made of environmentally inert materials, such as PVC plastic, stainless steel, fiberglass, etc., or by other suitable methods such as gluing or heated welding. If standard PVC pipes are used, their end caps and couplers will add thickness to the outside diameters of the PVC pipes, which prevents the prefect bonding of the PVC pipes and nesting of the stacked layers. To solve this problem, in one embodiment of the present invention, modified triangular shaped extrusion members 170 as shown in FIGS. 6 and 7 are used. More particularly, a modified triangular shaped extrusion member 172 is fitted in the central space between the three adjacent PVC pipes 112, 114 and 122. The extrusion members 170 may be made of any light weight and environmentally inert material, preferably the same PVC material as the pipes. The PVC pipes and extrusion members may be glued or heat welded together. The extrusion member 172 may be provided with a longitudinal central hole 174 to allow sea water to flow through the transverse cross section of the three dimensional pipe structure. Alternatively, the extrusion member 172 may be provided without the longitudinal central hole to prevent sea water from flowing through the transverse cross section of the three dimensional pipe structure. Each one of the extrusion members 170 may have any length and any overall cross sectional diameter. The preferred length and overall cross sectional diameter of an extrusion member are nineteen and half feet (19½') and six inches (6") respectively. The addition of these modified triangular shaped extrusion members has further provided adequate spaces between the PVC pipes to allow the end caps and couplers of the PVC pipes to be free from the pinpoint stresses from the adjacent stacked PVC pipes, as best illustrated in FIG. 6.

The thirty-nine (39) PVC pipes of each three dimensional pipe structure can be further bonded together at their proximal ends by an end board, as shown in FIG. 8. Shown in FIGS. 8 and 9, the thirty-nine (39) PVC pipes of the three dimensional pipe structure of the first elongated main leg 100 are bonded together at their proximal ends by a first end board 410. The end board 410 may be attached to the outer periphery of the outer PVC pipes with a generally trapezoid shaped flange 412. Similarly, a second end board 420 is attached to the proximal end of the three dimensional pipe structure of the second elongated main leg 200, and a third end board 430 is attached to the proximal end of the three dimensional pipe structure of the leading leg 300. It is realized that each end board is approximately nine feet wide and six feet high (9'×6'). Therefore these end boards should be made of strong and durable material which is also environmentally safe. By way of example only, these end boards may be made of one inch (1") thick metal board.

Referring to FIGS. 9 and 10, there is shown at 6 a complete construction of the generally Y-shaped artificial surfing reef having three legs each made of a large scale PVC pipe structure. The three legs are, again, the first main leg 100, the second main leg 200 and the leading leg 300. The three end boards 410, 420 and 430 of the three legs are attached together to form a generally triangular prism shaped joint 400, such that the two main legs 100 and 200 are separated by an appropriate angle. One preferred angle is ninety (90) degree. The leading leg 300 is disposed along a line which equally divides the angle between the two main legs 100 and 200. The generally triangular prism shaped joint 400 may further have a generally isosceles triangular shaped floor for reinforcing the structure of the joint 400 and ballasting purposes. After the artificial surfing reef 6 is placed on the offshore ocean floor bottom, a certain number of sand bags may be deposited on the floor 440 of the joint 5400 to provide proper ballast to the whole structure.

Using sand bags is only one of the many ballasting methods of the present invention artificial surfing reef. Other ways of ballasting are also anticipated by the various embodiments of the present invention. For example, the PVC pipe structures may be ballasted by pumping concrete into selected PVC pipes. Carefully selecting the concrete filled PVC pipes will provide appropriate weight to the whole structure and therefore increase the stability of the underwater artificial reef. In one preferred embodiment, the two outer pipes of the bottom layer of each three dimensional pipe structure, namely pipe pairs 112 and 212 of the main legs 100 and 200, and pipe pair 312 of the leading leg 300, are filled with concrete. This arrangement will provide the lowest center of gravity to the while reef structure and thereby increase its overall stability. These concrete filled pipes will also serve as the ridge beams of each pipe structure, which eliminate the twist or flex of the elongated legs. Of course the location and number of the PVC pipes to be filled with concrete are carefully determined so the added weight will no jeopardize the floatability of the artificial surfing reef.

The ability to float is also a significant novel feature of the present invention artificial surfing reef. The hollow chamber of each PVC pipe can be sealed by the end caps such as 111 and 211 (see FIG. 10), or other suitable sealing apparatus. All the hollow chambers of the PVC pipes of a respective pipe structure can be further interlinked together by small passages through the sidewalls of the PVC pipes to form an integral inner chamber, such as the small passage 123 shown in FIG. 6, which passage 123 interlinks the hollow chambers of pipes 122 and 124. Therefore each of the three legs 100, 200 and 300 will have an independent integral inner chamber. Valves will be provided on two pipes of the bottom layer and the top layer, respectively, of each pipe structure of the respective leg, to control the air and water passage into and out of each integral inner chamber. As shown in FIG. 8, in one embodiment, one inlet valve 113 is provided at the distal end of one of the top layer pipes of the pipe structure 100, and two outlet valves 115 are provided at the distal ends of two of the bottom layer pipes of the pipe structure 100. Similar valve arrangements are also provided to the other pipe structures 200 and 300. The valves are not provided on the outer-most pipes of the top and bottom layers of each pipe structure, because the outer-most pipes may be filled with concrete later for ballasting purpose. If the outer-most pipes are not going to be filled with concrete, then the valves may be provided on the outer-most pipes of the top and bottom layers of each pipe structure. Of course the valves may be provided at other locations along the designated pipes, such as their proximal ends of somewhere in the middle. The location of the valves are selected to facilitate the fast and complete air or water plumbing process.

The assembling of the pipe structures of the three legs 100, 200 and 300 will be carried out at a location near the ocean. After they are assembled, all the valves are closed, so that the integral inner chamber of each leg is filled with air, which makes each leg floatable on the ocean. Therefore the whole artificial surfing reef 6 can float on the ocean and be towed to a desired offshore surfing location. By opening the valves the three inner integral chambers of the artificial surfing reef 6 will be filled of water, and the artificial surfing reef 6 will submerge onto the offshore ocean floor bottom. The artificial surfing reef 6 can be further re-floated and towed away by pumping air into the top valves of each one of the three inner integral chambers of the respective pipe structures.

The joint 400 shown in FIGS. 9 and 10 are formed by the three respective end boards 410, 420 and 430 of the three legs 100, 200 and 300. It is preferable to build an independent triangular prism shaped hub. The triangular prism shaped hub is shown in FIG. 11 at 401. It has a front sidewall 431 and two lateral sidewalls 411 and 421, each being substantially the same size as the end board of the corresponding leg of the generally Y-shaped artificial surfing reef. As the artificial surfing reef is placed on the offshore ocean floor bottom, the front sidewall 431 of hub 401 is facing the offshore direction, and the two lateral sidewalls 411 and 421 of hub 401 are facing the shore direction diagonally. The hub 401 also has a generally isosceles triangular shaped floor 441, which makes the hub 401 looks like a triangular shaped cookie cutter. However, it should be understood that this is a large sized structure: each of its sidewalls is approximately nine foot wide and six foot high (9'×6'). The hub 401 should be built of similar material as the end boards of the legs, which may be metal as mentioned earlier. In the final orientation, the hub 401 can be bolted to the legs.

Figure 12:
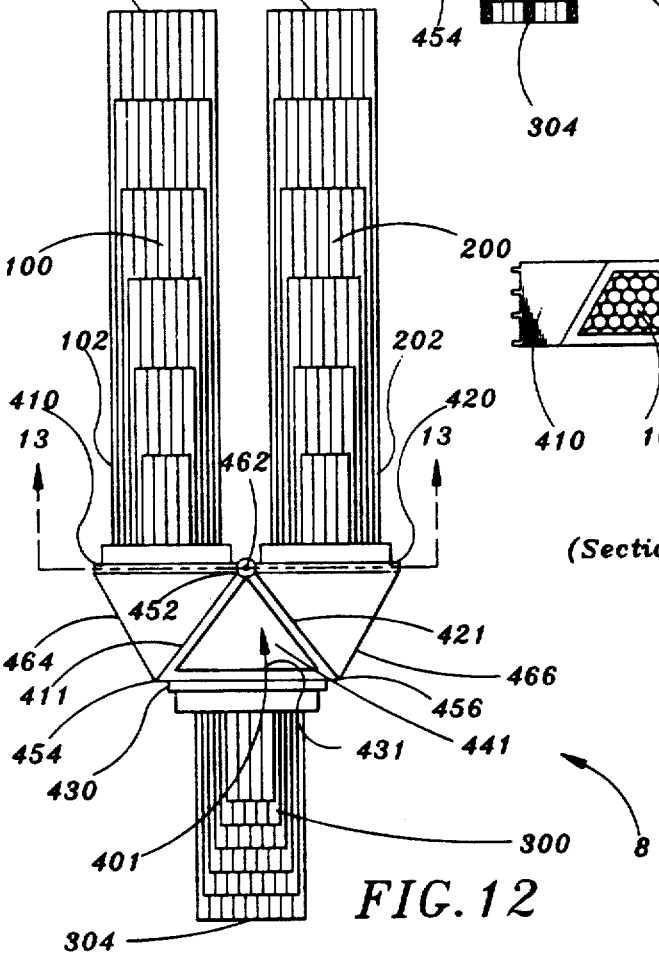
FIG. 12 is a top view of the present invention artificial surfing reef in the towing position, where its tow main legs are parallel.
Figure 13:
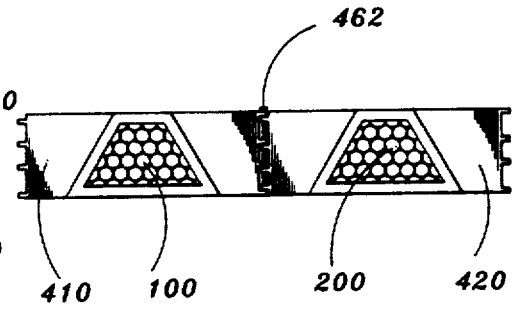
FIG. 13 is a cross sectional view which is taken along line 13—13 of FIG. 12 showing the hinge attachment of the two main legs of the present invention artificial surfing reef as they are in the parallel positions.

When such an independent hub 401 is employed, it provides more flexibility to the transportation and installation of the present invention artificial surfing reef. Referring to FIGS. 12, 13 and 14, there is shown generally at 8 a present invention artificial surfing reef utilizing the independent triangular prism shaped hub 401. Looking from above, the triangular prism shaped hub 401 has three corners: corner 452 between the two lateral sidewalls 411 and 421, and corners 454 and 456 between the front sidewall 431 and the two respective lateral sidewalls 411 and 421. There is a hinge member 462 mounted at the corner 452 for hingeably attaching the respective end boards 410 and 420 of the two main legs 100 and 200 to the corner 452. The end board 430 of the leading leg 300 is directly mounted to the front sidewall 431 of the hub 401. When the artificial surfing reef 8 is being towed rom the distal end 304 of its leading leg 300 on the surface of the water, the respective distal ends 104 and 204 of the two main legs 100 and 200 are swung in toward each other, such that the two main legs 100 and 200 are in parallel, to reduce the hydrodynamic resistance. As the structure is being towed, the respective end boards 410 and 420 of the two main legs are not directly attached to the respective lateral sidewalls 411 and 421 of the hub 401, but rather indirectly attached to the respective corners 454 and 456 of the hub 401 through respective strut or cable members 464 and 466. After the artificial surfing reef 8 is towed to the desired surfing location, the respective distal ends 104 and 204 of the two main legs 100 and 200 are swung out from each other, such that the two main legs 100 and 200 are separated by a desired angle, to form the generally Y-shaped configuration. Then the respective end boards 410 and 420 of the two main legs are directly mounted to the respective lateral sidewalls 411 and 421 of the hub 401, and the whole reef structure 8 is ready to be submerged.

Selected pipes may be filled with concrete to provide proper ballasting to the artificial reef as the final phase of construction. This is preferably done before the reef 8 is towed out to sea. The embodiment shown in FIG. 14 has fifteen pipes ballasted, five for each leg, as shown by the pipes with shading lines. The five ballasted pipes of each leg are the two outer pipes of the top layer, two outer pipes of the bottom layer, and the center pipe of the bottom layer. This arrangement provides greater stability as well as rigidity to the respective leg structure.

Since the whole reef structure is designed to be towed on the water, it is desirable to attach towing hardware such as rings or hook members to various appropriate locations of each individual leg. For example, it is desirable to have towing ring or hook members attached to the distal end 304 of the leading leg 300, the proximal and distal ends 102 and 104 of the first main leg 100, and the proximal and distal ends 202 and 204 of the second main leg 200. If the two outer PVC pipes of the bottom layer of each leg are ballasted with concrete, it is preferable to mount the respective towing hardware through these PVC pipes first, then fill these PVC pipes with concrete, so that the concrete will firmly anchor the towing hardware.

As the present invention artificial surfing reef is sunk into water and placed on the offshore ocean floor bottom, the highest point of the reef should be submerged in the water about one to two feet (1-2') at the lowest tide of that location, so that even at the lowest tide it will not be visible from the shore. In addition to creating perfect surfing waves, the present invention artificial reef also provides protection to the beach, because it dissipates the energy of the swell and therefore lessens the damage done by the swell to the near shore structures. If the artificial surfing reef needs to be removed or replaced, it can be re-floated by simply plumbing air into the upper valves to force the water out through the lower valves, and towed away to another location.

Defined in detail, the present invention is an artificial surfing reef for modifying a near shore ocean floor bottom to create surfing waves, comprising: (a) a generally Y-shaped structure having a leading leg and two main legs joined at a hub, where the leading leg extends away from the shore, and the two main legs extend toward the shore; (b) said leading leg and said two main legs each being a pipe structure assembled by a multiplicity of pipes made of light, rigid and environmentally inert material and each pipe having an elongated body with a hollow chamber; (d) said multiplicity of pipes of each said pipe structure being arranged in a multiplicity of stacked layers each having a respective number of identical pipes placed side by side; (e) means for bonding said multiplicity of pipes of each said pipe structure together; (f) means for sealing said hollow chambers of said multiplicity of pipes of each said pipe structure; (g) means for interconnecting said hollow chambers of said multiplicity of pipes of each said pipe structure, such that said leading leg and said two main legs each has an integrated hollow chamber; and (h) means for valving said integrated hollow chambers of said leading leg and said two main legs, such that when they are filled with air, said artificial surfing reef can float and be towed on the water, and when they are filled with water, said artificial surfing reef can sink on the ocean floor bottom; (i) whereby as a swell moves toward the shore, the bottom of the swell is resisted by said leading leg, and the top of the swell topples over said hub and is tapered by said two main legs to thereby form surfing waves.

Defined broadly, the present invention is an artificial surfing reef for modifying a near shore ocean floor bottom to create surfing waves, comprising: (a) a generally Y-shaped structure having a leading leg and two main legs joined at a joint, where the leading leg extends away from the shore, and the two main legs extend toward the shore; (b) said leading leg and said two main legs each being assembled by a respective group of elongated pipes made of light, rigid and environmentally inert material; (c) means for bonding said elongated pipes; and (d) means for sealing and valving said elongated pies, such that when they are filled with air, said artificial surfing reef can float and be towed on the water, and when they are filled with water, said artificial surfing reef can sink on the ocean floor bottom; (e) whereby as a swell moves toward the shore, its bottom is resisted by said leading leg, and its top topples over said joint and is tapered by said two main legs to thereby form surfing waves.

Defined more broadly, the present invention is an artificial surfing reef for modifying a near shore ocean floor bottom to create surfing waves comprising a generally Y-shaped structure having a leading leg and two main legs joined at a joint, where the leading leg extends from the joint away from the shore direction, whereby as a swell moves toward the shore, the bottom of the swell is resisted by the leading leg, and the top of the swell topples over the joint and is tapered by the two main legs to thereby form surfing waves.

Defined even more broadly, the present invention is an artificial surfing reef for modifying a near shore ocean floor bottom to create surfing waves comprising a generally V-shaped structure having two main legs joined at a joint furthest offshore, whereby as a swell moves toward the shore, the bottom of the swell is resisted by the joint, and the top of the swell topples over the joint and is tapered by the two main legs to thereby form surfing waves.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope or patent monopoly to be granted.

What is claimed is:

1. An artificial surfing reef for modifying a near shore ocean floor bottom to create surfing waves, comprising:

a. a generally Y-shaped structure having a leading leg and two main legs joined at a hub, where the leading leg extends away from the shore, and the two main legs extend toward the shore;

b. said leading leg and said two main legs each being a pipe structure assembled by a multiplicity of pipes made of light, rigid and environmentally inert material and each pipe having an elongated body with a hollow chamber;

c. said two main legs being substantially longer than said leading leg;

d. said multiplicity of pipes of each said pipe structure being arranged in a multiplicity of stacked layers each having respective number of identical pipes placed side by side; 'e. means for bonding said multiplicity of pipes of each said pipe structure together;

f. means for sealing said hollow chambers of said multiplicity of pipes of each said pipe structure;

g. means for interconnecting said hollow chambers of said multiplicity of pipes of each said pipe structure, such that said leading leg and said two main legs each has an integrated hollow chamber; and h. means for valving said integrated hollow chambers of said leading leg and said two main legs, such that when they are filled with air, said artificial surfing reef can float and be towed on the water, and when they are filled with water, said artificial surfing reef can sink on the ocean floor bottom;

i. whereby as a swell moves toward the shore, the bottom of the swell is resisted by said leading leg, and the top of the swell topples over said hub and is tapered by said two main legs to thereby form surfing waves.

2. The invention as defined in claim 1 wherein said multiplicity of stacked layers of each said pipe structure include a bottom layer, a top layer and at least one intermediate layer each having a proximal end and a distal end, where the proximal ends of all layers are aligned and adjacent to said hub.

3. The invention as defined in claim 2 wherein each said pipe structure further comprises an end plate mounted at the proximal ends of said multiplicity of stacked layers.

4. The invention as defined in claim 3 wherein said end plate of each said pipe structure is further mounted to said hub.

5. The invention as defined in claim 2 wherein the pipes placed in said bottom layer are longer than the pipes placed in said at least one intermediate layer, and the pipes placed in said top layer are shorter than the pipes placed in said at least one intermediate layer.

6. The invention as defined in claim 2 wherein the number of pipes placed in said bottom layer is more than the number of pipes placed in said at least one intermediate layer, and the number of pipes placed in said top layer is less than the number of pipes placed in said at least one intermediate layer.

7. The invention as defined in claim 1 wherein said hub is generally triangular prism shaped with a front sidewall facing the offshore, two lateral sidewalls diagonally facing the shore and a generally isosceles triangular shaped floor.

8. The invention as defined in claim 1 wherein said two main legs of said generally Y-shaped structure are hingeably attached to said hub, such that when said artificial surfing reef is floating on the water, said two main legs can be positioned parallel to each other and aligned with said leading leg to reduce the towing resistance, and when said artificial surfing reef is sunk on the ocean floor bottom, said two main legs can be positioned diagonally to form the Y-shape.

9. The invention as defined in claim 1 wherein said means for bonding said multiplicity of pipes of each said pipe structure includes modified triangular shaped interconnecting members.

10. The invention as defined in claim 1 wherein said means for sealing said hollow chambers of said multiplicity of pipes of each said pipe structure including end caps.

11. The invention as defined in claim 1 further comprising means for ballasting said artificial surfing reef.

12. The invention as defined in claim 1 wherein said multiplicity of pipes of each said pipe structure are large diameter Polyvinyl Chloride (PVC) pipes.

13. The invention as defined in claim 1 wherein said hub is constructed with metal material.

14. An artificial surfing reef for modifying a near shore ocean floor bottom to create surfing waves, comprising:

a. a generally Y-shaped structure having a leading leg and two main legs joined at a joint, where the leading leg extends away from the shore, and the two main legs extend toward the shore, the two main legs being substantially longer than the leading leg;

b. said leading leg and said two main legs each being assembled by a respective group of elongated pipes made of light, rigid and environmentally inert material;

c. means for bonding said elongated pipes; and d. means for sealing and valving said elongated pipes, such that when they are filled with air, said artificial surfing reef can float and be towed on the water, and when they are filled with water, said artificial surfing reef can sink on the ocean floor bottom;

e. whereby as a swell moves toward the shore, its bottom is resisted by said leading leg, and its top topples over said joint and is tapered by said two main legs to thereby form surfing waves.

15. The invention as defined in claim 14 wherein the heights of said leading leg and said two main legs of said generally Y-shaped structure are gradually increased longitudinally toward said joint of said generally Y-shaped structure.

16. The invention as defined in claim 14 wherein said leading leg and said two main legs of said generally Y-shaped structure have generally trapezoid shaped transverse cross sections.

17. The invention as defined in claim 14 wherein said leading leg and said two main legs of said generally Y-shaped structure have generally triangular shaped transverse cross sections.

18. The invention as defined in claim 14 wherein said elongated pipes are Polyvinyl Chloride (PVC) pipes.

19. An artificial surfing reef for modifying a near shore ocean floor bottom to create surfing waves, comprising:

a. a generally Y-shaped structure having a leading leg and two main legs joined at a joint, where the leading leg extends away from the shore, and the two main legs extend toward the shore;

b. said leading leg and said two main legs each being assembled by a respective group of elongated pipes made of light, rigid and environmentally inert material, and each further comprising an end plate, where the end plates are mounted together to form a generally triangular prism shaped hub;

c. means for bonding said elongated pipes; and d. means for sealing and valving said elongated pipes, such that when they ar filled with air, said artificial surfing reef can float and be towed on the water, and when they are filled with water, said artificial surfing reef can sink on the ocean floor bottom;

e. whereby as a swell moves toward the shore, its bottom is resisted by said leading leg, and its top topples over said joint and is tapered by said two main legs to thereby form surfing waves.

20. The invention as defined in claim 19 wherein each said end plate is constructed with metal material.

21. The invention as defined in claim 19 wherein said end plates of said leading leg and said two main legs of said generally Y-shaped structure are releasably and hingeably attached, such that when said artificial surfing reef is floating on the water, said two main legs can be positioned parallel to each other and aligned with said leading leg to reduce the towing resistance, and when said artificial surfing reef is sunk on the ocean floor bottom, said two main legs can be positioned diagonally to form the Y-shape.

22. An articifical surfing reef for modifying a near shore coean flor bottom to create surfing waves, comprising:

a. a generally Y-shaped structure having a leading leg and two main legs joined at a joint and interconnected by a generally triangular prism shaped hub where the leading leg extends away from the shore, and the two main legs extend toward the shore;

b. said leading leg and said two main legs each being assembled by a respective group of elongated pipes made of light, rigid and environmentally inert material;

c. means for bonding said elongated pipes; and d. means for sealing and valving said elongated pipes, such that whey they are filled with air, said aritificial surfing reef can float and be towed on the water, and when they are filled with water, said artificial surfing reef can sink on the ocean floor bottom;

e. whereby as a swell moves toward the shore, its bottom is resisted by said leading leg, and its top topples over said joint and is tapered by sid two main legs to thereby form surfing waves.

23. The invention as defined in claim 22 wherein said hub is constructed with metal material.

24. The invention as defined in claim 22 wherein said two main legs of said generally Y-shaped structure are hingeably attached to said hub, such that when said artificial surfing reef if floating on the water, said two main legs can be positioned parallel to each other and aligned with said leading leg to reduce the towing resistance, and when said artificial surfing reef is sunk on the ocean floor bottom, said two main legs can be positioned diagonally to form the Y-shape.

25. An artificial surfing reef for modifying a near shore ocean floor bottom to create surfing waves comprising a generally Y-shaped structure having a leading leg and two main legs joined at a joint, where the leading leg extends from the joint away from the shore direction, and the two main legs being substantially longer than the leading leg, whereby as a swell moves toward the shore, the bottom of the swell is resisted by the leading leg, and the top of the swell topples over the joint and is tapered by the two main legs to thereby form surfing waves.

26. The invention as defined in claim 25 wherein each one of said leading leg and said two main legs is assembled by a multiplicity of pipes made of light, rigid and environmentally inert material.

27. The invention as defined in claim 26 wherein said multiplicity of pipes are Polyvinyl Chloride (PVC) pipes.

* * * * *